United States Patent [19]

Nielson

[11] Patent Number: 4,513,359

[45] Date of Patent: Apr. 23, 1985

[54] LAMP STABILIZER

[75] Inventor: Wayne G. Nielson, Hutchinson, Minn.

[73] Assignee: Sterner Lighting Systems, Incorporated, Winsted, Minn.

[21] Appl. No.: 525,233

[22] Filed: Aug. 22, 1983

[51] Int. Cl.[3] ..... F21V 21/06

[52] U.S. Cl. ..... 362/389; 362/218; 362/285; 362/294; 362/369; 362/373; 362/390; 362/418; 362/430

[58] Field of Search ..... 362/218, 285, 294, 369, 362/373, 389, 390, 418, 430

[56] References Cited

U.S. PATENT DOCUMENTS

| | | | |
|---|---|---|---|
| 1,348,970 | 8/1920 | Thompson | 362/390 |
| 3,018,365 | 1/1962 | Wenman et al. | 362/369 |
| 3,767,912 | 10/1973 | Faux | 362/369 X |
| 4,360,861 | 11/1982 | Fitzgerald | 362/369 X |

*Primary Examiner*—Stephen J. Lechert, Jr.
*Attorney, Agent, or Firm*—Kinney & Lange

[57] ABSTRACT

A lamp stabilizer adapted to be mounted to the housing of a light fixture includes a mounting bracket secured to the light fixture and an elongated rigid rod slidably mounted for axial movement with respect to the bracket. The lamp stabilizer has a lamp engaging socket mounted on one end of the rod for selective engagement with an outer end portion of a lamp mounted in the housing. The lamp engaging socket is generally frustum-shaped and has at least one layer of heat insulating and lamp cushioning material secured to an inner side thereof for direct engagement with the outer end portion of the lamp. The lamp engaging socket is positioned with respect to the lamp by moving the rod with respect to the mounting bracket. A friction clip is selectively securable along the axial length of the rod and when secured thereto, engages the mounting bracket to restrict movement of the rod in direction away from the lamp. Preferably, the insulating and cushioning material has properties substantially equivalent to material sold under the trademark Fiberfrax.

19 Claims, 5 Drawing Figures

FIG. 1
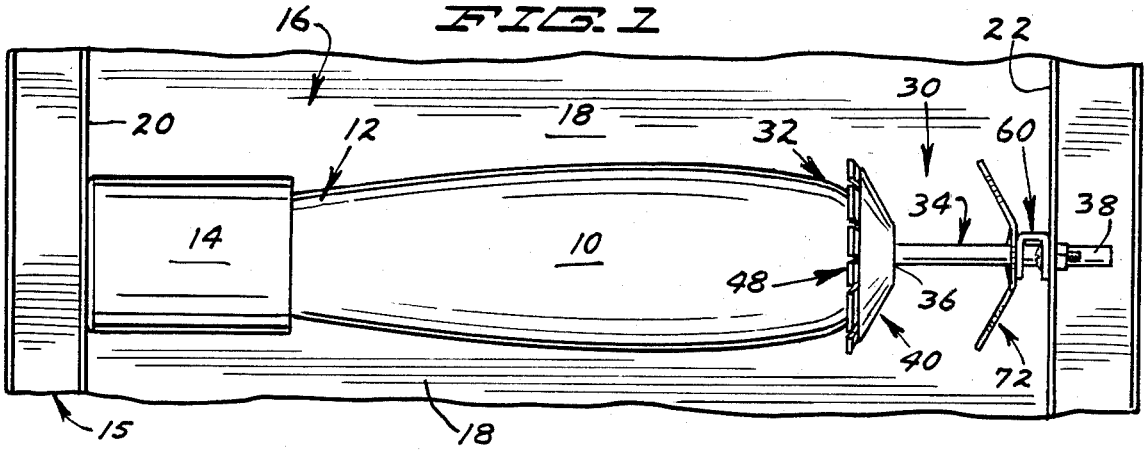
FIG. 3
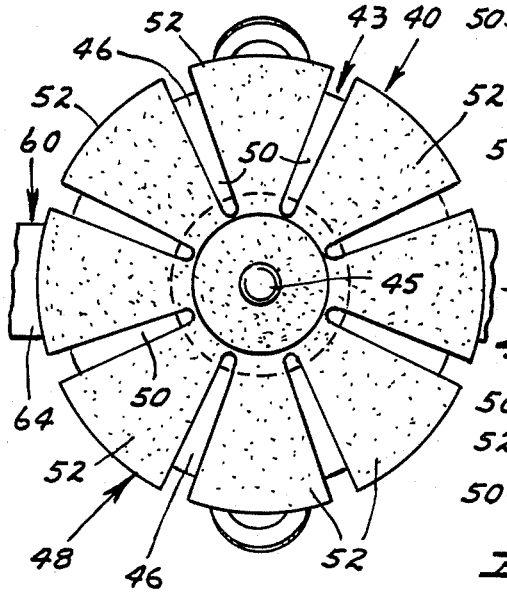
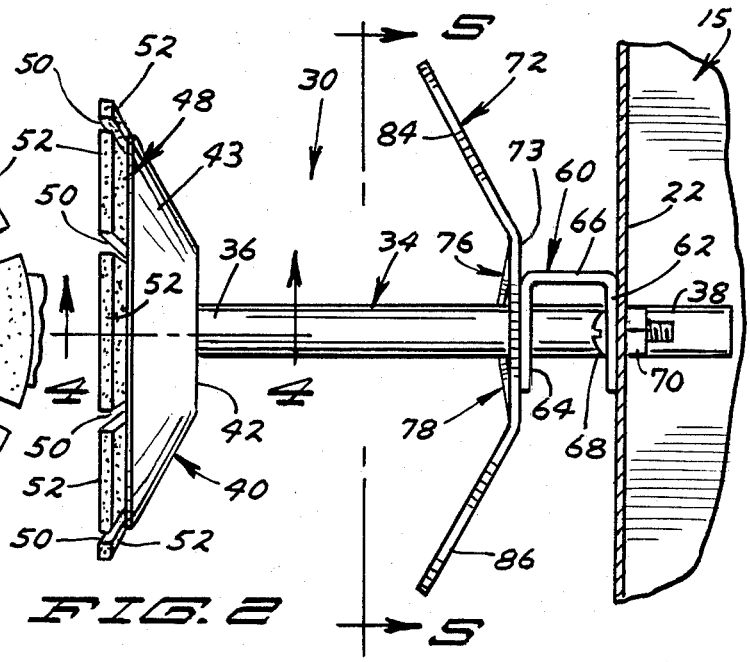
FIG. 2
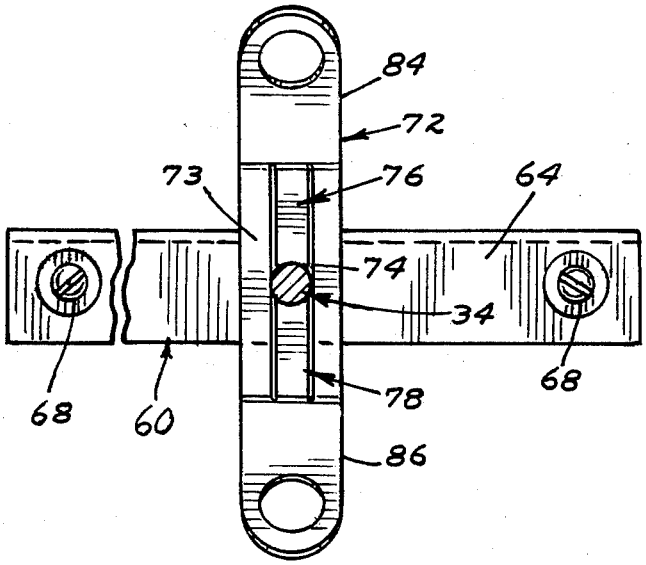
FIG. 5
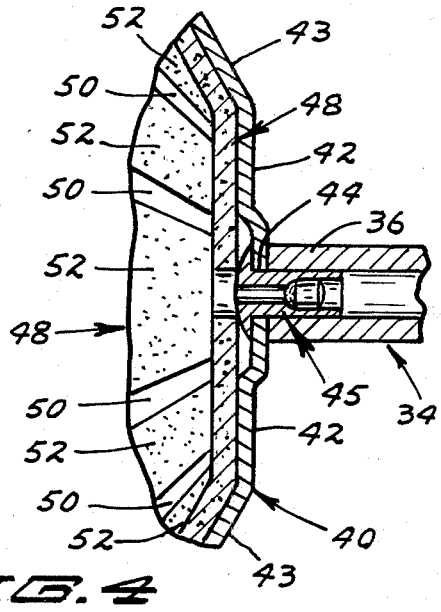
FIG. 4

LAMP STABILIZER

BACKGROUND OF THE INVENTION

1. Field of the Invention

The present invention relates to light fixtures, and particularly to sockets for engaging an outer end of a lamp mounted in a light fixture.

2. Description of the Prior Art

There has long been a need in the lighting industry for a lamp support to hold up the outer or non-electrical portion of a lamp in a lighting fixture. The advent of the extensive use of mercury, metal halide and high pressure sodium lamps, has further heightened this need. Such lamps come in very large sizes and their weight (when placed in a fixture to extend horizontally), causes them to lie at an angle so that they are not in proper focus. In operation, their relatively large size also causes them to vibrate to an early demise if unsupported. In addition, these lamp operate at temperatures of approximately 300° C. (572° F.) on the surface of the glass bulb of the lamp. Supporting such a lamp with a metal support or brace will cause the eventual decompositon of the glass because chemical interaction occurs at such high temperatures.

Certain materials have been used to coat that portion of a lamp support which engages the glass bulb, but with limited success. For example, molded teflon has been used, but this material has a melting point near 300° C. (572° F.) so there is very little margin of safety. Woven fiberglass sleeving has also been used, but this material eventually becomes frayed and then allows the metal support to contact the lamp bulb. Asbestos is no longer a viable option because its use is now restricted by law. In addition, none of these insulation materials provide any "cushion" to allow for expansion of the glass bulb as it becomes hot. Certain high energy lamps will continue to burn if their glass bulb is broken. If a lamp support is uncushioned, the glass bulb of a lamp can break upon expansion, with the lamp continuing to burn and thereby radiating harmful ultraviolet radiation.

Various attempts to support the outer portions of such high energy lamps are shown in U.S. Pat. No. 3,911,265, granted to Landrum et al. on Oct. 7, 1975, U.S. Pat. No. 3,781,539, granted to Landrum et al. on Dec. 25, 1973 and U.S. Pat. No. 3,610,915, granted to Moore on Oct. 5, 1971. The lamp fixture and support devices shown in these three patents are unsuitable for the reasons as stated above related to heat support and cushioning, as well as the fact that the support devices shown therein for the lamp bulbs take up excessive space inside of the lamp fixture reflector and hence cannot be used in fixtures where space is close between lamp and reflector. In addition, the outer end supports shown in these three patents are not shaped so as to fit different styles or types of lamps which may be installed in a particular lamp fixture. If a lamp with a different type outer portion or end is inserted in such lamp fixtures, it may necessarily require the changing of the type of lamp support, since its configuration may not be suitable for the different lamp. The present invention provides a lamp stabilizer for the outward portion of a high energy lamp which overcomes the disadvantages of the prior art.

SUMMARY OF THE INVENTION

A lamp stabilizer adapted to be mounted to the housing of a light fixture for selectively engaging an outer end of a lamp mounted in an electrical lamp socket in the housing includes an elongated rigid rod and socket means fixedly mounted on one end of the rod proximate the outer end of the lamp in the housing. The socket means provides heat insulating and cushioning surfaces which diverge outwardly therefrom in a generally conical pattern to engage the outer end of the lamp. The rod is slidably axially mounted with respect to the housing by mount means which also position the insulating and cushioning surfaces with respect to the lamp. Lock means are provided to selectively limit movement of the rod in direction away from the outer end of the lamp.

Preferably, the heat insulating and cushioning surfaces comprise at least one layer of insulation paper having the properties of Fiberfrax secured to those portions of the socket means which engage the outer end of the lamp to cushion and support the lamp and provide heat insulation between the lamp and the lamp stabilizer. The socket means is fixedly secured on the one end of the rod so that there is no relative axial movement therebetween. The lock means is preferably a friction clip having an aperture therein and at least one integral tab adjacent the aperture with a free end of the tab extending toward the aperture. The rod is slidably mounted in the aperture with the free end of the tab engaging the rod to selectively restrict the movement of the rod with regard to the friction clip. The friction clip, in turn, engages the mount means to selectively limit movement of the rod in direction away from the lamp.

BRIEF DESCRIPTION OF THE DRAWINGS

FIG. 1 is a partial plan view of a light fixture having a lamp stabilizer of the present invention mounted thereon.

FIG. 2 is an enlarged side view of the lamp stabilizer of the present invention with portions of the light fixture shown in section and broken away.

FIG. 3 is an end view of the socket portion of the lamp stabilizer of the present invention.

FIG. 4 is a partial sectional view as taken along line 4—4 in FIG. 2.

FIG. 5 is a sectional view as taken along line 5—5 in FIG. 2.

DETAILED DESCRIPTION OF THE PREFERRED EMBODIMENTS

As shown in FIG. 1, a lamp 10 has its electrical end 12 secured in an electrical socket 14. The electrical socket 14 is mounted to a housing 15 of a light fixture 16. Typically, the electrical socket 14 will be mounted within the reflector portion 18 of the light fixture 16 and positioned so that light emitted from the lamp 10 reflects off of the reflector portion 18 and toward the area where illumination is desired. As shown in FIG. 1, the electrical socket 14 is mounted to a first wall portion 20 of the housing 15 of the light fixture 16.

The light fixture 16 has a second wall portion 22 which is generally parallel to and spaced from the first wall portion as shown. A lamp stabilizer 30 of the present invention is adapted to be mounted to the second wall portion 22 of the housing 15 of the light fixture 16 for selectively engaging an outer or non-electrical end portion 32 of the lamp 10. The lamp stabilizer 30 includes an elongated rigid rod 34 slidably mounted for movement along its axis with respect to the light fixture in direction toward and away from the lamp 10 and electrical socket 14. The rod 34 has a first end 36 and a second end 38. A lamp engaging socket 40 is secured to the rod 34 adjacent its first end 36 as shown.

As best shown in FIGS. 2 and 3, the lamp engaging socket 40 has a circular base portion 42 which is fixedly secured to the first end 36 of the rod 34 at its center. An open end portion 43 of the lamp engaging socket 40 is connected to the base portion 42 and radiates outwardly therefrom. The open end portion 43 is shaped like a frustum of a cone, with its larger end being open for reception of the outer end portion 32 of the lamp 10. The frustum-shaped open end portion 43 has a central longitudinal axis and its smaller end is mounted to the base portion 42, which closes off the smaller end and is centrally mounted to the first end 36 of the rod 34. The frustum-shaped open end portion 43 is thus coaxially positioned with respect to the circular base portion 42 and rod 34.

As shown in FIG. 4, the circular base portion 42 of the lamp engaging socket 40 has an aperture 44 therein. A pop rivet 45 extends through the aperture 44 and into the first end 36 of the rigid rod 34, which is formed as a tube for acceptance of the pop rivet 45. The pop rivet 45 thus fixedly secures the lamp engaging socket 40 to the rigid rod 34 so that no axial movement of these elements with respect to each other is possible.

The open end portion 43 of the lamp engaging socket 40 has an inner surface 46 which is generally conical in shape. As shown, a layer of heat insulating and lamp cushioning material 48 is secured to the inner surface 46 of the lamp engaging socket 40. Preferably, the material 48 is at least one layer of fibrous insulation paper. As shown, the insulation paper is generally circular-shaped with a plurality of radially spaced slits 50 therethrough. Each slit 50 extends from the periphery of the circular-shaped insulation paper to a separate point based from its center to creat a plurality of insulation paper petals 52 which lie against the inner surface 46 of the lamp engaging socket 40 when secured thereto. The insulation paper is thus positioned within the open end portion 43 of the lamp engaging socket 40 to diverge outwardly therefrom in a generally conical pattern for engagement with the outer end portion 32 of the lamp 10.

Preferably, the insulation paper has properties substantially equivalent to that of insulation paper sold under the Trademark "Fiberfrax", which is manufactured by the Insulation Division of the Carborundum Company of Niagara Falls, N.Y. Fiberfrax paper is a flexible, lightweight sheet having exceptionally low thermo-conductivity and good handling properties. Fiberfrax paper is also slightly resilient, so that a layer of Fiberfrax paper can serve as a cushioning, sealing or gasket means. Fiberfrax paper contains no asbestos and has a continuous use heat tolerance of about 1,260° C. (2,300° F.). The use of such insulation paper on the lamp engaging socket 40 of the present invention thus provides means to cushion and support the outer end portion 32 of the lamp 10 and provide heat insulation between the lamp 10 and the lamp stabilizer 30. The insulation paper does not allow any hard surfaces or metal portions of the lamp stabilizer 30 to engage the bulb of the lamp 10 and does not react with the glass of the bulb to cause its deterioration.

The elongated rigid rod 34 is mounted to the housing 15 of the light fixture 16 by a mount member or bracket 60 secured to the second wall portion 22 of housing 15. As best shown in FIG. 2, the mount bracket 60 is a U-shaped channel which has a first side wall 62 proximate the second wall portion 22 of the housing 15, a second side wall 64 generally parallel to and spaced from the first side wall 62 and a third or base wall 66 connecting the first and second side walls 62 and 64 and generally perpendicular thereto. The first and second side walls 62 and 64 are apertured for slidable reception of the rod 34. The second wall portion 22 of the housing 15 is also apertured for slidable reception of the rod 34. The mount bracket 60 is secured to the second wall portion 22 by suitable fastening means, such as bolts 68 and nuts 70 as shown, so that the apertures of the first and second side walls 62 and 64 and the second wall portion 22 are aligned for slidable reception of the rigid rod 34 along its axis. The mount bracket 60 is secured to the housing 15 of the light fixture 16 to align the lamp stabilizer 30 for engagement of the lamp engaging socket 40 with the outer end portion 32 of a lamp 10 which is mounted in the electrical socket 14 of the light fixture 16.

Lock means are provided for fixing the position of the rigid rod 34 with respect to the mount bracket 60 and lamp 10. The lock means preferably comprise a lock member or friction clip 72 which is selectively slidable along the axial length of the rigid rod 34 and selectively secureable to the rigid rod 34. As shown, the friction clip 72 has a central portion 73 with an aperture 74 therein, and a pair of diametrically opposed integral tabs 76 and 78 extending toward the aperture 74. The tabs 76 and 78 are integrally formed from the central portion 73 of the friction clip 72, with each tab 76 and 78 having a free end 80 and 82, respectively, which extends toward the aperture 74 to engage the rigid rod 34. The engagement of the free ends of the tabs 76 and 78 with the rod 34 selectively restricts movement of the rod 34 with regard to the friction clip 72. The friction clip 72 is thus secured to the rod 34 in this manner and is positioned for use on the rod 34 between the lamp engaging socket 40 and the mount bracket 60. Movement of the rod 34 toward the mount bracket 60 then causes the friction clip 72 to engage the second side wall 64 of the mount bracket 60 which thereby limits movement of the rod 34 axially in direction away from the lamp 10.

The friction clip 72 has outer wing portions 84 and 86 secured at opposite ends of the central portion 73. Pressure exerted on the wing portions 84 and 86 in direction toward the second wall portion 22 of the housing 15 causes the central portion 73 of the friction clip 72 to bend or bow toward the lamp engaging socket 40 and causes the free ends 80 and 82 of the tabs 76 and 78 to disengage with the rod 34 and move in direction toward the lamp engaging socket 40. When such pressure is exerted, the friction clip 72 is thus disengaged from the rigid rod 34 and can be slidably adjusted with respect to the rod 34. The release of the pressure on the outer wing portions 84 and 86 of the friction clip 72 allows the free ends 80 and 82 of the tabs 76 and 78 to re-engage the rod 34 so that the firction clip 72 is again secured thereto. The friction clip 72 is thus adjustable in position axially along the rigid rod. This, in turn, permits the position of the rigid rod 34 and the lamp engaging socket 40 to be adjusted relatively to the mount bracket 60 and lamp 10.

In operation, lamp 10 is first secured in the electrical socket 14. The lamp engaging socket 40 is then moved into engagement with the outer end portion 32 of the lamp 10. The lamp engaging socket 40 is positioned so that the outer end portion 32 of the lamp 10 is received within the open end portion 43 of the lamp engaging socket 40 and to support and cushion the lamp 10 with the heat insulating and lamp cushioning material 48. With the lamp engaging socket 40 so positioned, the friction clip 72 is moved along the axis of the rod 34 until it engages the second side wall 64 of the mount bracket 60. At this point, the friction clip 72 is secured to the rod 34 so that the position of the rod 34 and the lamp engaging socket 40 is fixed with respect to the lamp 10. The lamp stabilizer 30 thus supports the outer end portion 32 of the lamp 10, with the heat insulating and lamp cushioning material 48 permitting the lamp 10 to expand slightly as its temperature increases during operation while acting to provide an insulated support for the lamp 10. The slits 50 in the insulation paper additionally prevent the outer end portion 32 of the lamp 10 from becoming overheated by allowing the heat to escape from the lamp 10 and heat insulating and cushioning material 48. To change the lamp 10 or adjust the position of the lamp stabilizer 30, the friction clip 72 is simply moved (by applying appropriate pressure to the outer wing portions 84 and 86) along the rod 34 until the lamp engaging socket 40 which is fixed to the rod 34 is positioned as desired.

Although the present invention has been described with reference to preferred embodiments, workers skilled in the art will recognize that changes may be made in form and detail without departing from the spirit and scope of the invention.

What is claimed is:

1. A lamp stabilizer comprising:

(a) mount means adapted to be mounted with respect to a light fixture;

(b) an elongated rigid rod slidably mounted for movement along its axis with respect to the mount means;

(c) a lamp engaging socket having a base portion, an open end portion and an inner surface, the base portion of the lamp engaging socket being fixedly secured to one end of the rod and positioned such that an outer end of a lamp mounted in the electrical lamp socket of a light fixture mounting the mount means is received within the open end portion of the socket;

(d) friction clip means for adjustably limiting movement of the rod along its axis in direction away from such a lamp; and (e) heat insulating and lamp cushioning means secured to the inner surface of the lamp engaging socket adjacent its open end portion for engagement with the outer end of such a lamp.

2. The invention of claim 1 wherein the lamp engaging socket has a central axis and is mounted on the rod coaxially with the axis of the rod.

3. The invention of claim 1 wherein the base portion of the lamp engaging socket is circular and is secured on one end of the rod coaxially therewith, and wherein the open end portion of the lamp-engaging socket is frustum-shaped with its larger end being open for reception of the outer end of a lamp and its smaller end being mounted to the base portion so that the frustum-shaped open end portion is also coaxially positioned with respect to the rod.

4. The invention of claim 3 wherein the base portion of the lamp engaging socket is secured to the end of the rod by a pop rivet so that the lamp engaging socket cannot move axially with respect to the rod.

5. The invention of claim 1 wherein the heat insulating and lamp cushioning means comprises at least one layer of fibrous insulation paper.

6. The invention of claim 5 wherein the inner surface of the lamp engaging socket is generally conical in shape and the insulation paper is circular-shaped with a plurality of radially spaced slits therethrough, each slit extending from the periphery of the circular-shaped insulation paper to a separate point spaced from its center to create a plurality of insulation paper petals which lie against the inner surface of the lamp engaging socket when secured thereto.

7. The invention of claim 5 wherein the insulation paper is an asbestos-free and resilient lightweight sheet having low thermo-conductivity properties.

8. The invention of claim 1 wherein the friction clip means comprises a lock member having an aperture therein and at least one integral tab adjacent the aperture with a free end of the tab extending toward the aperture, the rod being slidably mounted in the aperture with the free end of the tab engaging the rod to selectively restrict the movement of rod with regard to the lock member and the lock member engaging the mount means to selectively limit movement of the rod in direction away from the lamp.

9. The invention of claim 8 wherein the lock member has two tabs, the free ends of which extend toward each other and the aperture.

10. The invention of claim 1 wherein the friction clip means comprises a lock member selectively secured to the rod between the lamp engaging socket and the mount means, the lock member engaging the mount means to limit movement of the rod in direction along its axis toward the mount means.

11. The invention of claim 5 wherein the insulation paper has a continuous use heat tolerance limit of about 1260° C. (2300° F.).

12. A light fixture combination, comprising:

a housing for receiving and supporting a lamp;

a lamp stabilizer mounted with respect to the housing for selectively engaging an outer portion of such a lamp; and at least one layer of resilient insulation paper having low thermo-conductivity properties and a continuous use heat tolerance limit of about 1260° C. (2300° F.), the insulation paper being secured to those portions of the lamp stabilizer which engage the outer portion of the lamp to cushion and support the lamp and provide heat insulation between the lamp and the lamp stabilizer.

13. The invention of claim 12 wherein the lamp stabilizer comprises:

a lamp engaging socket having an inner surface formed in a generally conical shape for reception of the outer portion of the lamp, with the insulation paper affixed to the inner surface of the lamp engaging member; and adjustment means for selectively positioning the lamp engaging member relative to the lamp.

14. The invention of claim 13 wherein the adjustment means comprises:

an elongated rigid rod having one end thereof secured to the lamp engaging socket;

a mount member secured to the housing and apertured for slidable reception of the rod; and lock means selectively secured to rod between the lamp engaging socket and the mount member for engaging the mount member to limit movement of the rod and lamp engaging socket in direction away from the lamp.

15. A socket for use in engaging the non-electrical end of a lamp mounted in the housing of a light fixture, the socket comprising:

(a) mount means adapted to be mounted with respect to a light fixture housing;

(b) an elongated rigid rod mounted slidably axially with respect to the mount means;

(c) socket means fixedly mounted on an end of the rod proximate a non-electrical end of a lamp in a light fixture housing mounting the mount means for providing heat insulating and cushioning surfaces which diverge outwardly therefrom in a generally conical pattern to engage such a non-electrical end of the lamp; and (d) lock means to selectively limit movement of the rod in direction away from such a non-electrical end of the lamp.

16. The invention of claim 15 wherein the heating insulating and cushioning surfaces of the socket means comprise at least one layer of insulation paper which is an asbestos-free and resilient lightweight sheet having low thermo-conductivity properties.

17. The invention of claim 15 wherein the socket means comprises:

a frustum-shaped socket having its smaller circular end closed, with the smaller circular end of the socket being secured at its center to the end of the rod by a pop rivet so that the socket does not move axially with respect to the rod; and at least one layer of insulation paper affixed to an inner surface of the frustum-shaped socket.

18. The invention of claim 16 wherein the insulation paper is generally circular-shaped with a plurality of radially spaced slits therethrough, each slit extending from the periphery of the circular-shaped insulation paper to a separate point spaced from its center to create a plurality of insulation paper petals which lie against the inner surface of the frustum-shaped socket.

19. The invention of claim 14 wherein the lock means comprises:

a friction clip selectively securable axially with respect to the rod such that the clip engages the mount means to limit movement of the rod and socket means mounted thereon.

* * * * *